US009990803B2

(12) United States Patent
Imudia et al.

(10) Patent No.: US 9,990,803 B2
(45) Date of Patent: Jun. 5, 2018

(54) ELECTRONIC GAMING DEVICE WITH SUBSCRIPTION BASED PROGRESSIVE FUNCTIONALITY

(71) Applicant: Cadillac Jack, Inc., Duluth, GA (US)

(72) Inventors: Godfrey Imudia, Grayson, GA (US); Jared Torres, Atlanta, GA (US); Steven Davis, Suwanee, GA (US)

(73) Assignee: AGS LLC, Las Vegas, NV (US)

( * ) Notice: Subject to any disclaimer, the term of this patent is extended or adjusted under 35 U.S.C. 154(b) by 564 days.

(21) Appl. No.: 14/030,885

(22) Filed: Sep. 18, 2013

(65) Prior Publication Data

US 2015/0080102 A1 Mar. 19, 2015

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3258* (2013.01); *G07F 17/3255* (2013.01); *G07F 17/34* (2013.01)

(58) Field of Classification Search

CPC ..... G07F 17/3255; G07F 17/34
USPC ..... 463/16, 20, 25, 40–42, 26–28
See application file for complete search history.

(56) References Cited

U.S. PATENT DOCUMENTS 5,116,055 A 5/1992 Tracy
5,356,140 A 10/1994 Dabrowski et al.
5,732,950 A 3/1998 Moody
8,172,671 B2 5/2012 Walker et al.
2006/0019736 A1* 1/2006 Amada ..... A63F 3/06 463/17
2006/0082062 A1 4/2006 Caterinicchio et al.
2006/0253324 A1* 11/2006 Miller ..... G06Q 30/02 705/14.14
2008/0032801 A1* 2/2008 Brunet de Courssou ..... G07F 17/32 463/42
2008/0119284 A1* 5/2008 Luciano, Jr. ..... G07F 17/3244 463/42
2008/0305853 A1* 12/2008 Roitman ..... G07F 17/32 463/25
2010/0331076 A1* 12/2010 Dickerson ..... G07F 17/32 463/26
2014/0106843 A1 4/2014 Cole et al.
2015/0024823 A1 1/2015 Tarantino

OTHER PUBLICATIONS

Liz Benston, "New draw: Video poker with a guarantee," http://lasvegassun.com/news/2006/nov/26/new-draw-video-poker-with-a-guarantee/, Nov. 26, 2006, 8 pages.

* cited by examiner

*Primary Examiner* — Omkar Deodhar
*Assistant Examiner* — Ross Williams
(74) *Attorney, Agent, or Firm* — Weide & Miller, Ltd.

(57) ABSTRACT

Examples disclosed herein relate to an electronic gaming device including a memory, a processor, and a plurality of reels. The plurality of reels may include one or more areas. The memory may include one or more one or more subscription based progressive structures. The processor may generate one or more symbols to be located in the one or more areas.

17 Claims, 22 Drawing Sheets

503

530 532 534 536 538

| JOIN | NAME | COST | JACKPOT |
|---|---|---|---|
| ☐ (540) | PROGRESSIVE JACKPOT 1 | 1 CREDIT | $1,000.00 |
| ☑ (542) | PROGRESSIVE JACKPOT 2 | $1.00 | $10,000.00 |
| ☐ | PROGRESSIVE JACKPOT 3 | 5 CREDITS | $50,000.00 |
| ☑ | PROGRESSIVE JACKPOT 4 | $1.50 | $1,000,000.00 |
| ... | ... | ... | ... |
| ☐ | PROGRESSIVE JACKPOT N$^{TH}$ | 10 CREDITS | $10,000,000.00 |

600A 630 632 634 636 638

640

| JOIN | NAME | JACKPOT | |
|---|---|---|---|
| ☐ | PROGRESSIVE JACKPOT 1 | $1,000.00 | PAYOUT ALGORITHM = α |
| ☐ | PROGRESSIVE JACKPOT 2 | $10,000.00 | |
| ☐ | PROGRESSIVE JACKPOT 3 | $60,000.00 | |
| ☐ | PROGRESSIVE JACKPOT 4 | $1,000,000.00 | |
| ... | ... | ... | |
| ☐ | PROGRESSIVE JACKPOT N$^{TH}$ | $10,000,000.00 | |

FIG. 6A

600B 630 632 640

650 652

| JOIN | NAME | JACKPOT | |
|---|---|---|---|
| ☐ | PROGRESSIVE JACKPOT 1 | $1,000.00 | PAYOUT ALGORITHM = β |
| ☑ | PROGRESSIVE JACKPOT 2 | $10,000.00 | |
| ☐ | PROGRESSIVE JACKPOT 3 | $60,000.00 | |
| ☑ | PROGRESSIVE JACKPOT 4 | $1,000,000.00 | |
| ... | ... | ... | |
| ☐ | PROGRESSIVE JACKPOT N$^{TH}$ | $10,000,000.00 | |

FIG. 6B

600C 630 632 642

| JOIN | NAME | JACKPOT | |
|---|---|---|---|
| ☐ | PROGRESSIVE JACKPOT 1 | $1,000.00 | PAYOUT ALGORITHM = λ |
| ☑ (650) | PROGRESSIVE JACKPOT 2 | $10,000.00 | |
| ☐ | PROGRESSIVE JACKPOT 3 | $60,000.00 | |
| ☑ (652) | PROGRESSIVE JACKPOT 4 | $1,000,000.00 | |
| ... | ... | ... | |
| ☑ (654) | PROGRESSIVE JACKPOT N$^{TH}$ | $10,000,000.00 | |

FIG. 6C

ELECTRONIC GAMING DEVICE WITH SUBSCRIPTION BASED PROGRESSIVE FUNCTIONALITY

FIELD

The subject matter disclosed herein relates to an electronic gaming device. More specifically, the disclosure relates to providing one or more subscription based progressive functionalities on a gaming device.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more subscription based progressive functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

FIG. 6A is another illustration of subscription based progressive game play on a gaming device, according to one embodiment.

FIG. 6B is another illustration of subscription based progressive game play on a gaming device, according to one embodiment.

FIG. 6C is another illustration of subscription based progressive game play on a gaming device, according to one embodiment.

DETAILED DESCRIPTION

Figure 1:
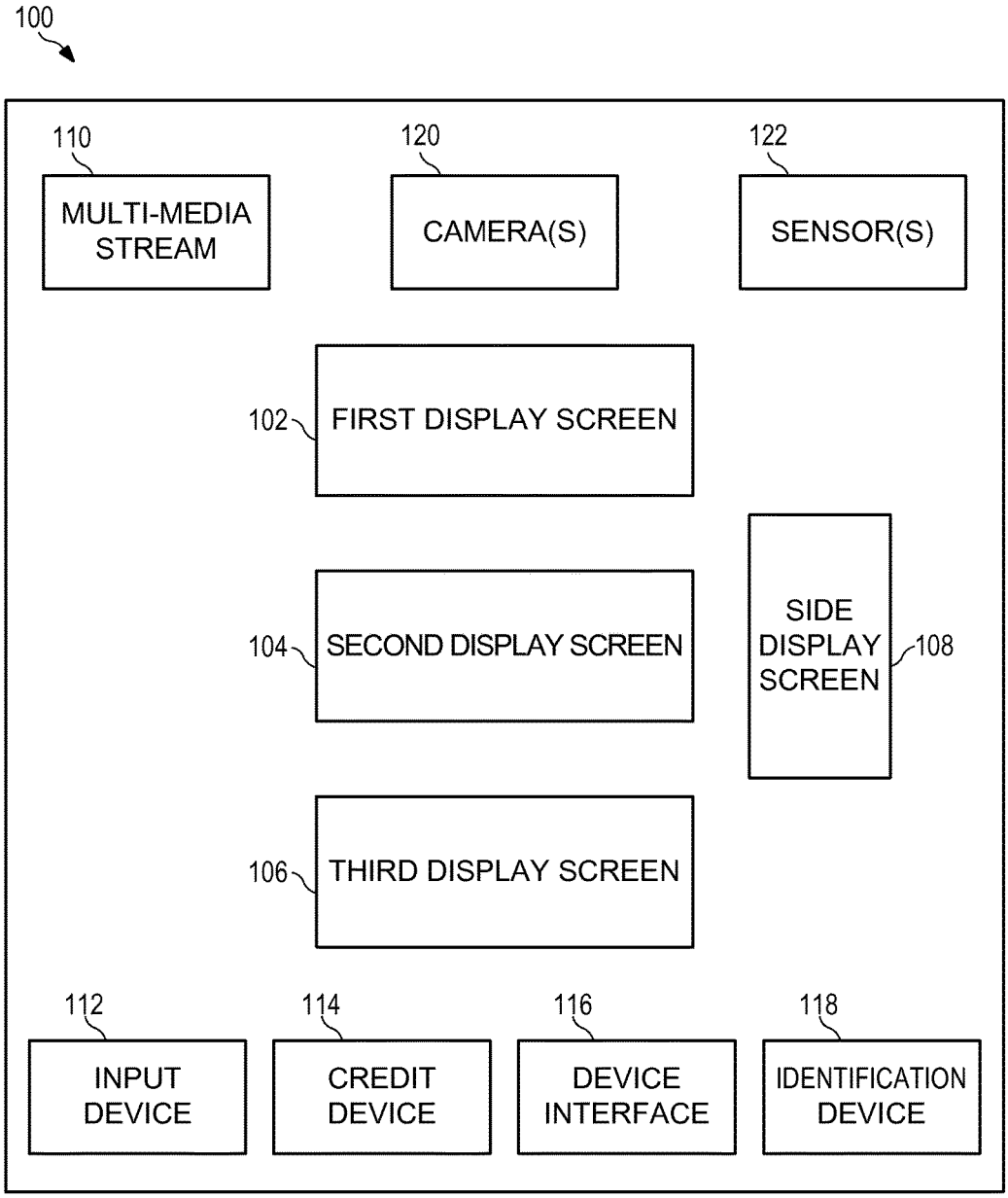
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more subscription based progressive gaming options, to make a wager, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game functionalities (e.g., game type 1, game type 2, game type 3, etc.) may be presented, a subscription based progressive gaming option may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include subscription based progressive gaming options only. Therefore, only games which include subscription based progressive gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display one or more warnings relating to one or more audio devices, one or more display devices, one or more electrical wires, one or more springs, one or more motors, one or more adjustable devices, and/or one or more sensors, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Electronic gaming device 100 may include at least one display device. Electronic gaming device 100 may include a base display and/or a second display. In one embodiment, base display may be the primary display for a first game. In another embodiment, second display may be the primary display for a second and/or bonus game. For example, base display may display: a reel-type video slot game; and upon a bonus game triggering condition; second display may display a bonus game; and upon a subscription based progressive game feature triggering event; first and/or second display may display a subscription based progressive game feature.

In one embodiment, base display and second display may display separate portions of a common image. For example, second display may display a top portion of a wheel spinning while base display may display the bottom portion of the same wheel spinning.

Electronic gaming device 100 may also include one or more speakers. In one embodiment, one or more speakers may work in a synchronized manner to provide a surround sound effect. For example, as an object is displayed moving across base display from left to right, one or more speakers may produce sound in such a manner as to create an audible sense of similar left to right movement. In another embodiment, one or more speakers may work asynchronously. In a further embodiment, a first speaker may produce sounds associated with a first symbol appearing in a play of a game, and a second speaker may produce sounds associated with a second symbol appearing in a play of the game.

Figure 2:
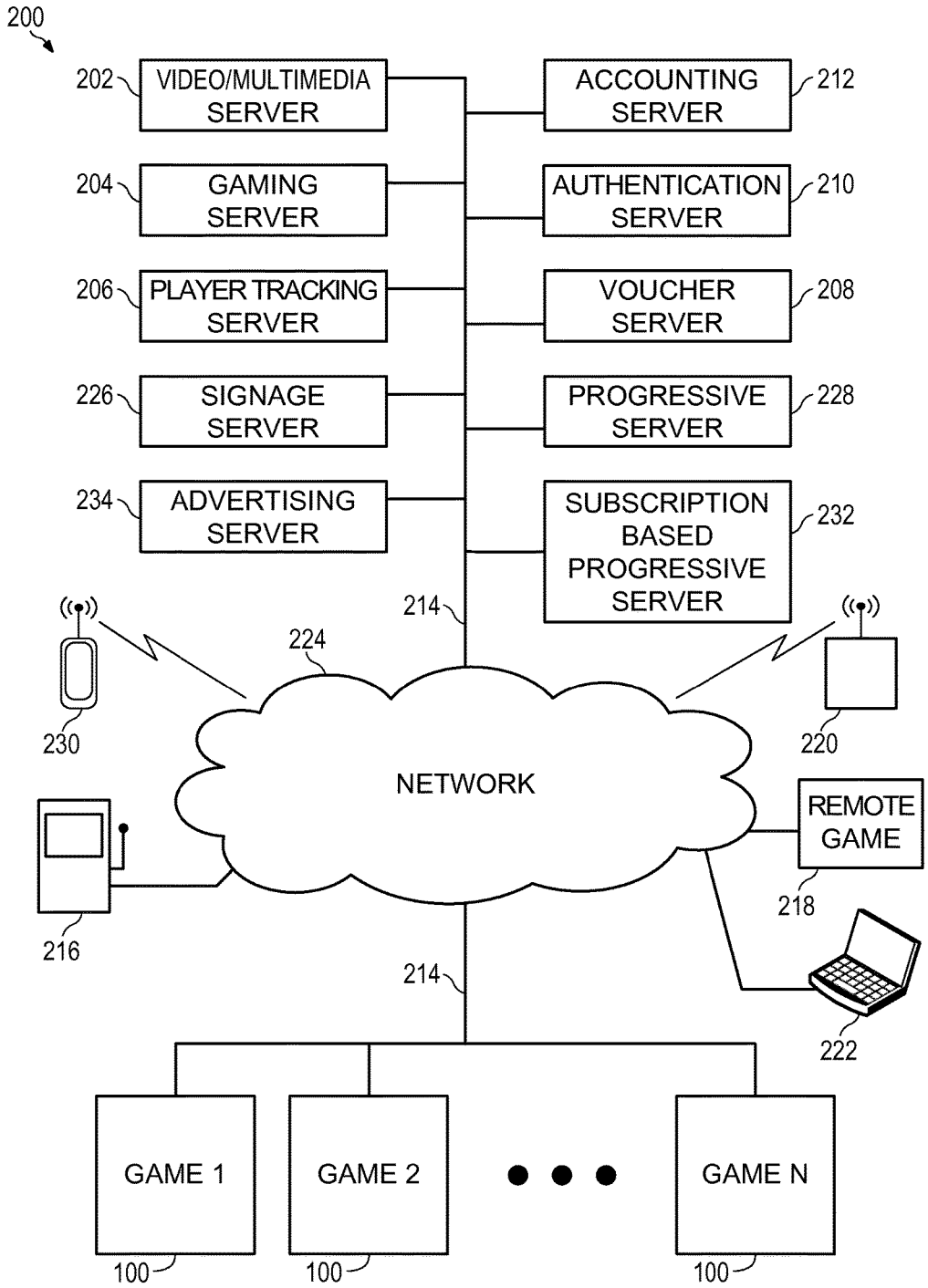
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a subscription based progressive game feature functionality; a subscription based progressive game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.)

may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Figure 3:
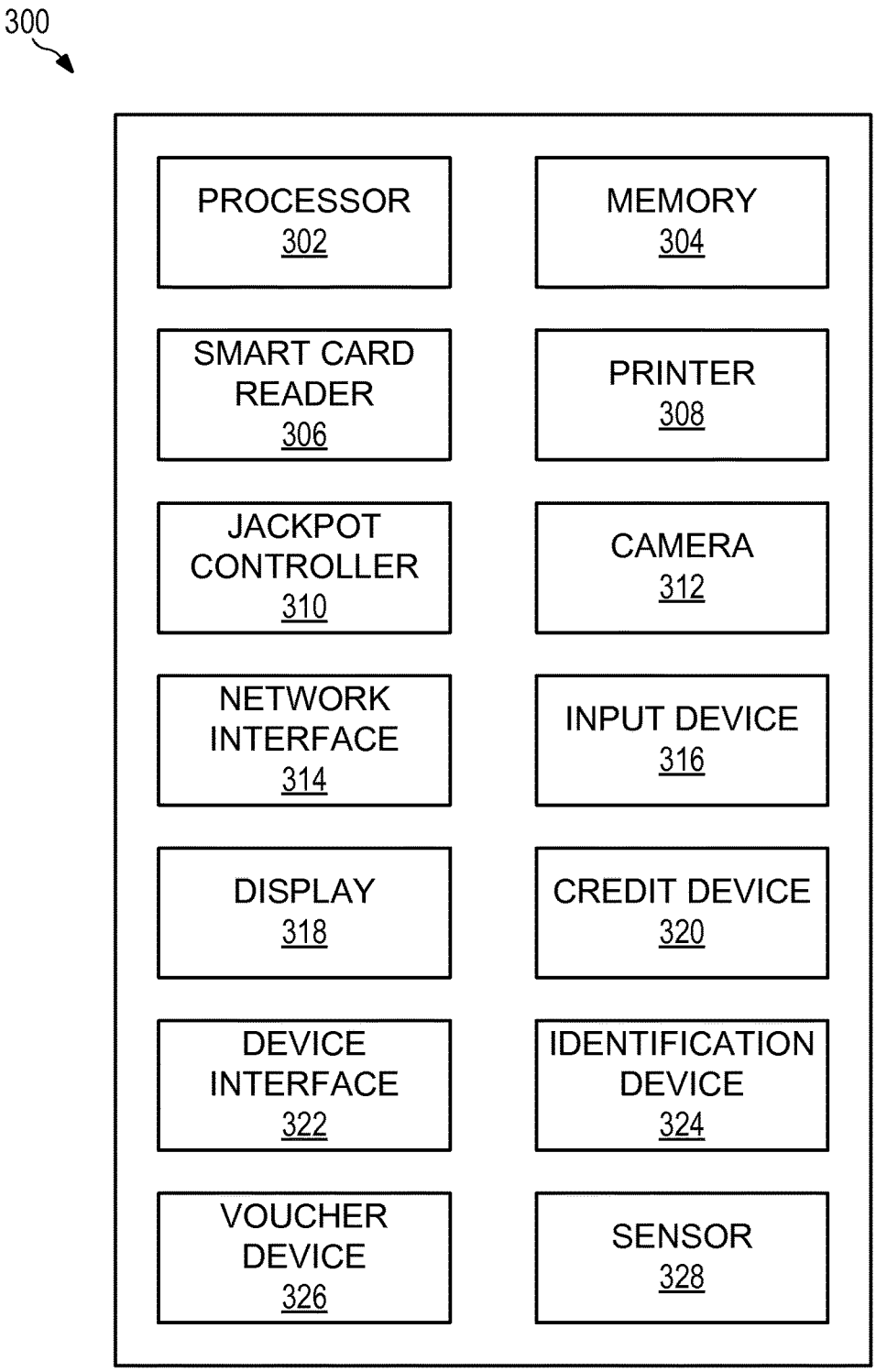
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to modify one of one or more audio devices, one or more display devices, one or more electrical wires, one or more springs, one or more motors, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
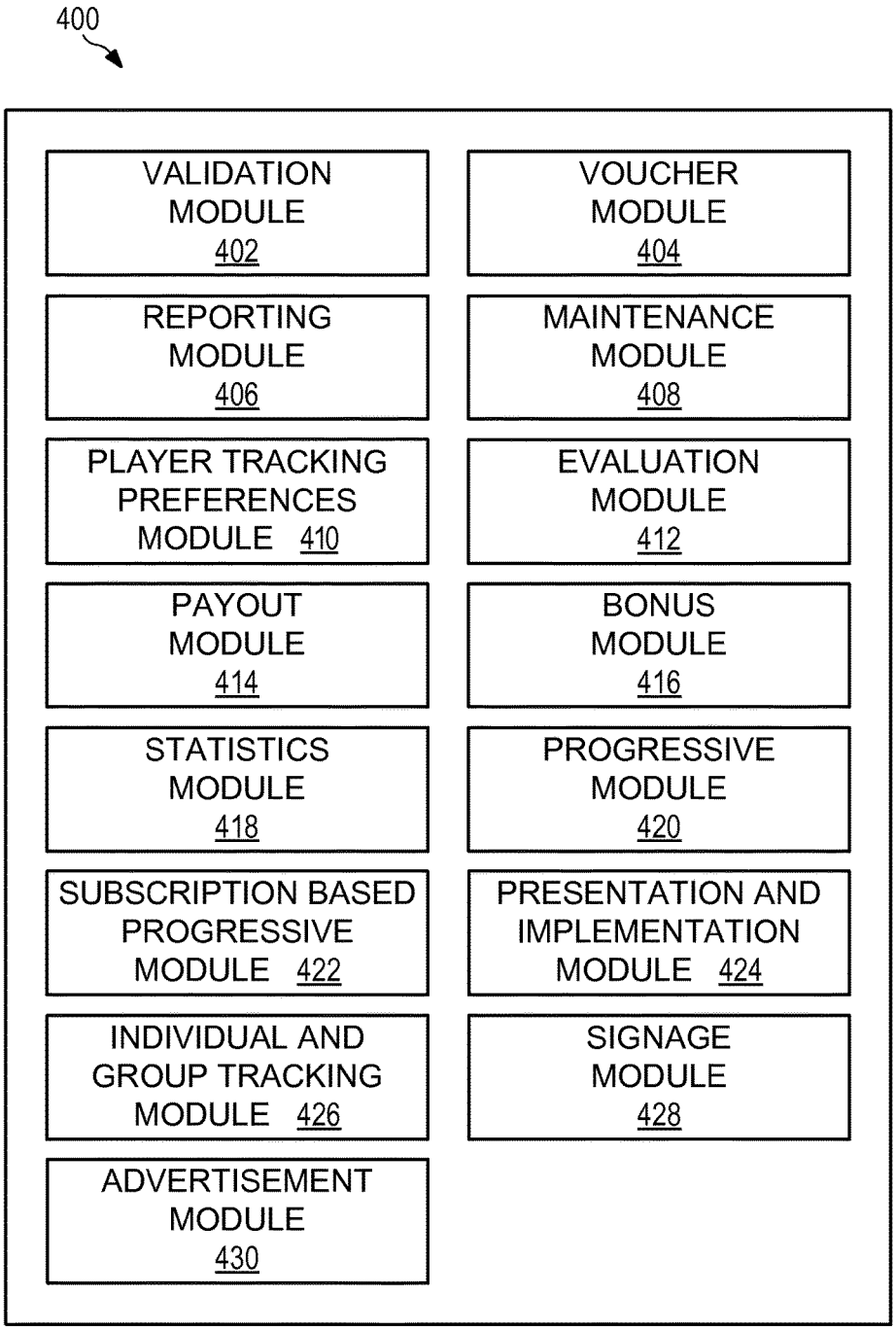
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an animation module, a game evaluation module 412, a payout module 414, a sensor module, a scene module, a sensor and scene evaluation module, a sensor and scene output module, a reference models module, an audio module, an audio device adjustment module, a display device adjustment module, a bonus module 416, a statistics module 418, a progressive module 420, a subscription based progressive module 422, a presentation and implementation module 424, an individual and group tracking module 426, a signage module 428, and an advertisement module 430.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Game evaluation module 412 may evaluate one or more outcomes for one or more events relating to game play.

Payout module 414 may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players)

from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Bonus module 416 may generate a bonus game, evaluate the results of the bonus game, trigger bonus game presentations, generate bonus game payouts, and/or display any data relating to the bonus game.

Statistics module 418 may generate, compile, transmit, and/or store data relating to one or more subscription based progressive histories.

Progressive module 420 may generate, compile, transmit, and/or store one or more progressive structures and/or any other data relating to one or more progressive structures and/or progressive game play.

Subscription based progressive module 422 may generate, compile, transmit, and/or store one or more subscription based progressive structures and/or any other data relating to one or more subscription based progressive structures and/or subscription based progressive game play.

Presentation and implementation module 424 may generate, transmit, and/or implement one or more presentations associated with game play, progressive game play, and/or subscription based progressive game play.

Individual and group tracking module 426 may generate, compile, transmit, and/or store data relating to an individual, individuals, and/or groups which are participating in one or more subscription based progressive.

Signage module 428 may generate, compile, transmit, and/or store data relating to one or more subscription based progressive. The data may be presented on one or more display screens.

Advertisement module 430 may generate, compile, transmit, and/or store advertisement information relating to one or more subscription based progressive. These advertisements may be presented on one or more display screens, an internet website, and/or any other advertisement avenue.

Wild module may generate a wild game, evaluate the results of the wild game, trigger wild game presentations, generate wild game payouts, and/or display any data relating to the wild game. Further, wild module may determine one or more outcomes of one or more interactions (e.g., collisions of one or more symbols).

Scatter module may generate a scatter game, evaluate the results of the scatter game, trigger scatter game presentations, generate scatter game payouts, and/or display any data relating to the scatter game.

Installation verification module may verify the installation parameters on one or more of audio devices, one or more display devices, one or more electrical wires, one or more springs, one or more motors, one or more adjustable devices, and/or one or more sensors to one or more reference data points. Installation verification module may generate a warning when the data points are outside of a specific parameter range. One or more warnings may be transmitted to an external device, a server, a mobile device, and/or a warning display on electronic gaming device 100 based on the verification data.

Locking module may control the locking mechanism for one or more audio devices, one or more display devices, one or more electrical wires, one or more springs, one or more motors, one or more adjustable devices, and/or one or more sensors. Locking module may control any locking mechanism for electronic gaming device 100. Locking module may generate a warning when a locking data point is outside of a specific parameter. These warnings may be transmitted to an external device, a server, a mobile device, and/or a warning display on electronic gaming device 100.

It should be noted that one or more modules may be combined into one module. Further, there may be one evaluation module where the determined payout does not depend on whether there were any wild symbols, scatter symbols, platform based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
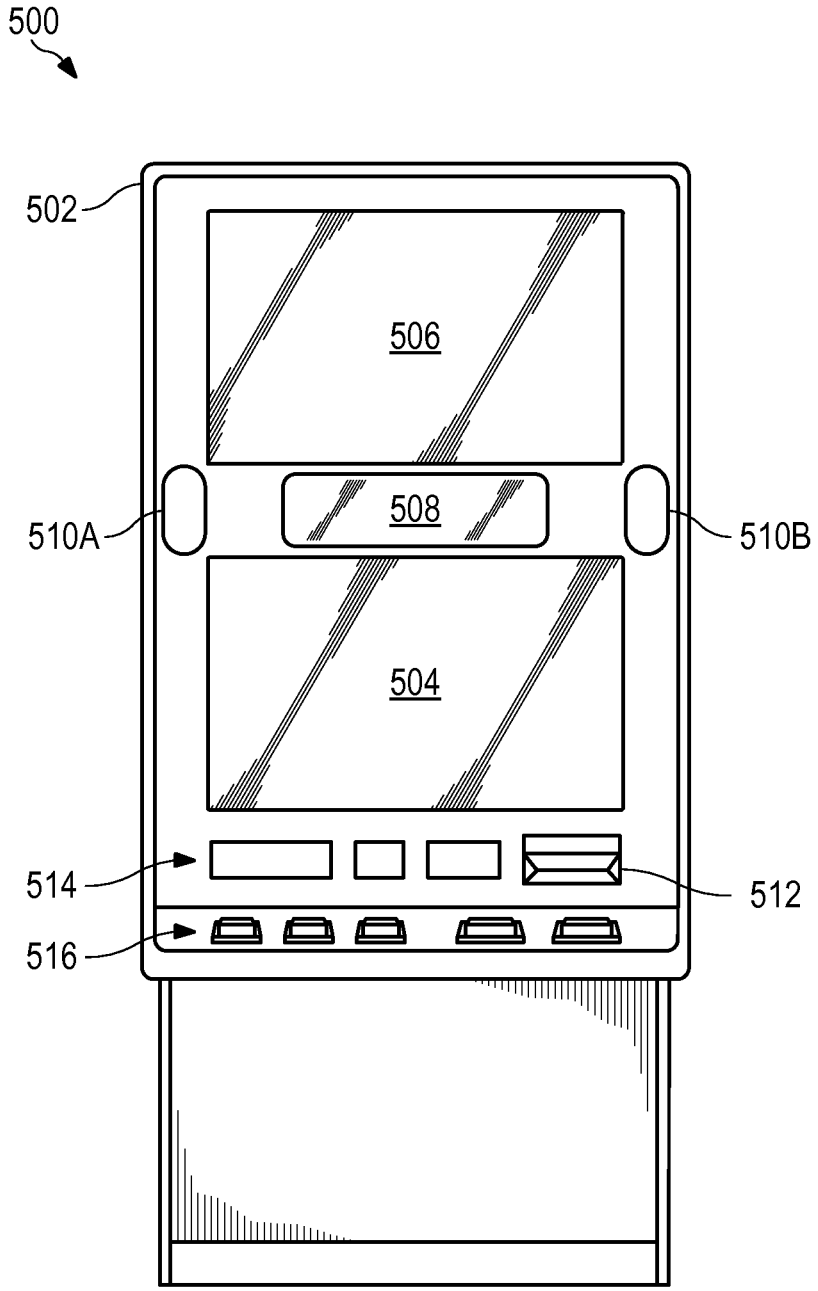
FIG. 5A is an illustration of subscription based progressive game play on a gaming device, according to one embodiment.

In FIG. 5A, an illustration of a gaming device cabinet 500 is shown, according to one embodiment. A gaming device 502 may include an overhead display 506, a side display 508, a main game display 504, a left speaker 510A, a right speaker 510B, one or more output devices (e.g., a ticket in/ticket out device 512), and/or one or more input devices 516 (e.g., buttons, etc.). In one example, overhead display 506 includes a leadership board sponsor and/or a ranking of tournament players. In this example, the XYZ company has sponsored the leadership board and the leadership board states "XYZ LEADER BOARD." In another example, leadership display may include data relating to one or more tournaments, such as, the time remaining (e.g., 1 HOUR 31 MINUTES REMAINING). In this example, side display 508 may display a current mode of operation. For example, a current mode may be a tournament mode, a normal mode, a practice mode, a team mode, an individual mode, any combination thereof, etc.

Figures 5B, 5C:
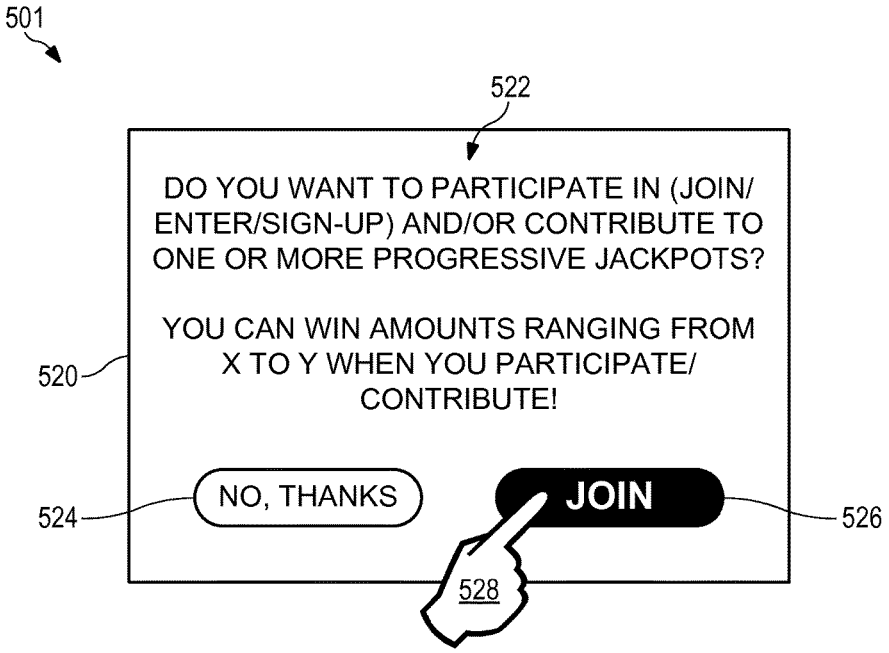
FIG. 5B is another illustration of subscription based progressive game play on a gaming device, according to one embodiment.
FIG. 5C is another illustration of subscription based progressive game play on a gaming device, according to one embodiment.

In FIG. 5B, another illustration of subscription based progressive game play on a gaming device 501 is shown, according to one embodiment. In this example, a message box 520 may be displayed on one or more screens of a gaming device. Message box 520 may include a message area 522, a first selection option 524, a second selection option 526, and an Nth selection option (not shown). Message area 522 may include a description of the subscription based progressive and/or any other data relating to one or more subscription based progressive options. For example, message area 522 may display the message of "DO YOU WANT TO PARTICIPATE IN (JOIN/ENTER/SIGN-UP) AND/OR CONTRIBUTE TO ONE OR MORE PROGRESSIVE JACKPOTS? YOU CAN WIN AMOUNTS RANG- ING FROM X TO Y WHEN YOU PARTICIPATE/CONTRIBUTE!" In one example, first selection option 524 may be an option to decline participation in the subscription based progressive program. In this case, first selection option 524 may state "NO, THANKS." In another example, second selection option 526 may be an option to accept/request participation in the subscription based progressive program. In this case, second selection option 526 may state "JOIN." In various examples, "JOIN" may be replaced by any similar word (e.g., accept, yes, participate, etc.).

In FIG. 5C, another illustration of subscription based progressive game play on a gaming device 503 is shown, according to one embodiment. In one example, a first image 503 may include an options area 530. Options area 530 may include a selection option area 532, a name of the option area 534, a cost of the option area 536, and a prize of the option area 538. In one example, selection option area 532 is titled "JOIN", name of the option area 534 is called "NAME", cost of the option area 536 is titled "COST", and prize of the option area 538 is titled "JACKPOT". In one example, name of the option area 534 may include any number of names for any number of options. In this case, a first option is named "PROGRESSIVE JACKPOT 1", a second option is named "PROGRESSIVE JACKPOT 2", a third option is named "PROGRESSIVE JACKPOT 3", a fourth options is named "PROGRESSIVE JACKPOT 4", and an Nth option is named "PROGRSSIVE JACKPOT NTH."

In one example, PROGRESSIVE JACKPOT 1 has a cost of 1 credit and a potential jackpot of $1,000. In another example, PROGRESSIVE JACKPOT 2 has a cost of $1 and a potential jackpot of $10,000. In another example, PROGRESSIVE JACKPOT 3 has a cost of 5 credits and a potential jackpot of $50,000. In a further example, PROGRESSIVE JACKPOT 4 has a cost of $1.50 and a potential jackpot of $1,000,000. In another example, PROGRESSIVE JACKPOT NTH has a cost of 10 credits and a potential jackpot of $10,000,000. In this example, the player has elected to participate in PROGRESSIVE JACKPOT 2 AND PROGRESSIVE JACKPOT 4 which is indicated by a checked box 542. Whereas, the player has elected to not participate in PROGRESSIVE JACKPOT 1, PROGRESSIVE JACKPOT 3, AND PROGRESSIVE JACKPOT NTH which is indicated by a blank box 540. In various examples, the player may select none of the progressives, one progressive, a few progressives, a plurality of the progressives, and/or all of the progressives. In various examples, the cost for a progressive may be constant (e.g., 10 credits) and/or may vary (e.g., 10 credits for the first entry and then 5 credits for the second entry and then 1 credit for the third entry, etc.). In another example, the system and/or method may require a first payment of 10 credits (e.g., any number) and then a lesser payment (e.g., 5 credits, etc.) to continue to be eligible for the progressive. In another example, the payment requirement to remain eligible may go up. This increase in payment may be related to the number of participates in the progressive pool, the prize size of the jackpot, and/or any other factor. In another the example, the payment to remain eligible in a progressive may be decreased based on a player entering more than one progressive subscription. In another example, the payment may be decreased based on the length of time a player has subscribed to one or more progressive jackpot options.

Figure 5D:
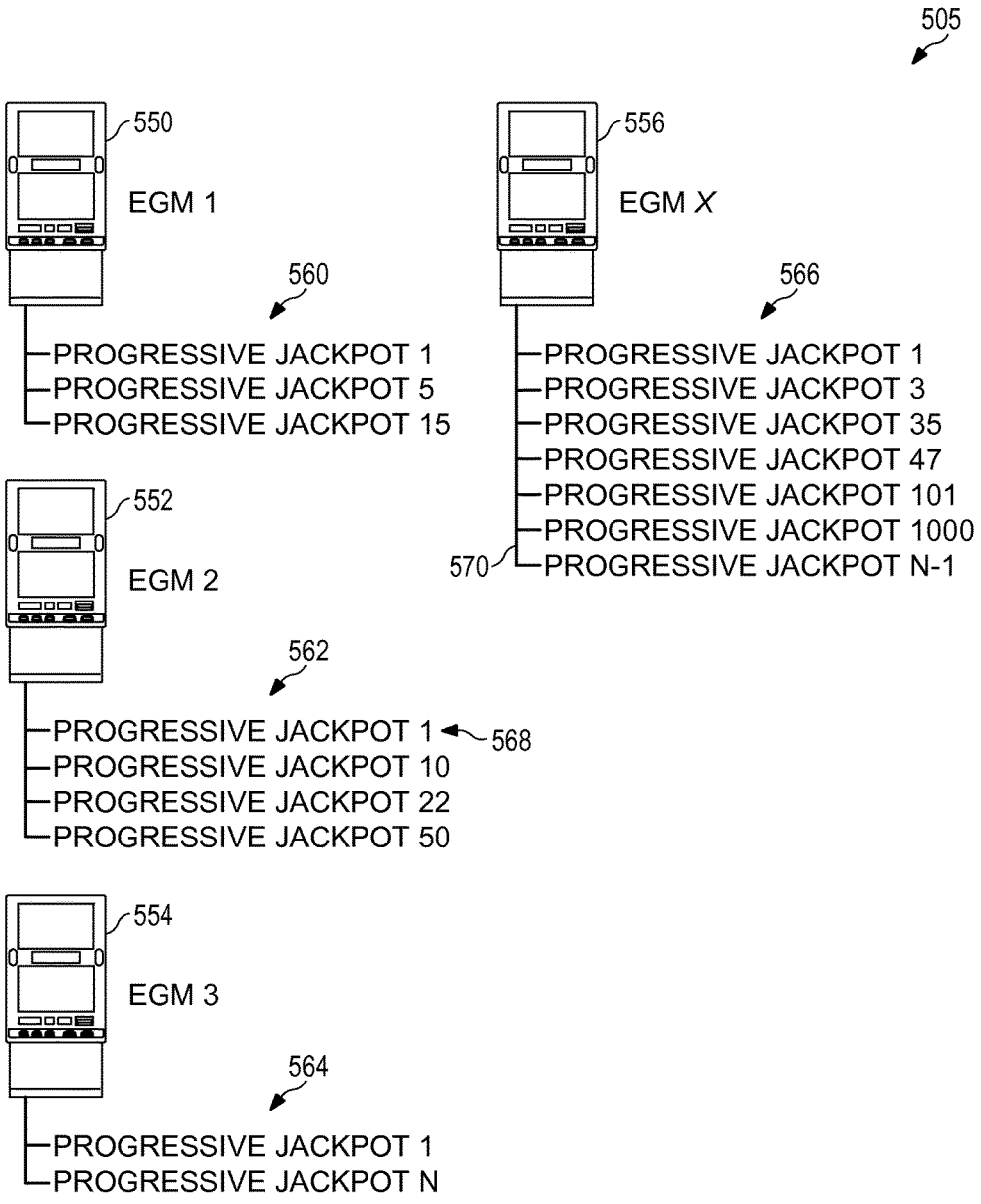
FIG. 5D is another illustration of subscription based progressive game play on a gaming device, according to one embodiment.

In FIG. 5D, another illustration of subscription based progressive game play on a gaming device is shown, according to one embodiment. In one example, an image 505 includes a plurality of electronic gaming devices. In this example, a first electronic gaming device 550 may have three subscription progressive options. In this example, the three subscription progressive options are a PROGRESSIVE JACKPOT 1, PROGRESSIVE JACKPOT 5, and PROGRESSIVE JACKPOT 15. It should be noted that any electronic gaming device may have one, a few, and/or a plurality of non-subscription based progressive options in combination with subscription based progressive options and/or as a stand-alone function. Further, it should be noted that any electronic gaming device may have one, a few, and/or a plurality of subscription based progressive options. In addition, electronic gaming device on a gaming entity's floor may have constant subscription progressive based options, varying subscription progressive based options, and/or a combination of both depending on the time of day, floor configuration, special event, and/or any other reason.

In another example, a second electronic gaming device 552 may have four subscription progressive options. In this example, the four subscription progressive options are a PROGRESSIVE JACKPOT 1, PROGRESSIVE JACKPOT 10, PROGRESSIVE JACKPOT 22, and PROGRESSIVE JACKPOT 50. In another example, a third electronic gaming device 554 may have two subscription progressive options. In this example, the two subscription progressive options are a PROGRESSIVE JACKPOT 1 and PROGRESSIVE JACKPOT N. In another example, an X electronic gaming device 550 may have seven subscription progressive options. In this example, the seven subscription progressive options are a PROGRESSIVE JACKPOT 1, PROGRESSIVE JACKPOT 3, PROGRESSIVE JACKPOT 35, PROGRESSIVE JACKPOT 47, PROGRESSIVE JACKPOT 101, PROGRESSIVE JACKPOT 1000, and PROGRESSIVE JACKPOT N−1.

In FIG. 6A, another illustration of subscription based progressive game play on a gaming device 600A is shown, according to one embodiment. In one example, an image may include an options area 630. Options area 630 may include a selection option area 632, a name of the option area 634, a prize of the option area 636, and a payout algorithm area 638. In one example, selection option area 632 is titled "JOIN", name of the option area 634 is called "NAME", and prize of the option area 638 is titled "JACKPOT". In one example, name of the option area 634 may include any number of names for any number of options. In this case, a first option is named "PROGRESSIVE JACKPOT 1", a second option is named "PROGRESSIVE JACKPOT 2", a third option is named "PROGRESSIVE JACKPOT 3", a fourth options is named "PROGRESSIVE JACKPOT 4", and an Nth option is named "PROGRSSIVE JACKPOT NTH."

In one example, the cost associated with the selection of one or more of PROGRESSIVE JACKPOT 1, PROGRESSIVE JACKPOT 2, PROGRESSIVE JACKPOT 3, PROGRESSIVE JACKPOT 4, and/or PROGRESSIVE JACKPOT NTH is imbedded in modifying the payout algorithm. For example, when no subscription based progressive options are selected the system has a payout algorithm which equals alpha. However, when a player selects one or more subscription based progressive options the payout algorithm is modified. For example in FIG. 6B, the player has selected to participate in PROGRESSIVE JACKPOT 2 AND PROGRESSIVE JACKPOT 4, which generates a new payout algorithm beta. In this example, payout algorithm beta may generate a reduce payout rate (e.g., 90%) versus the payout rate (e.g., 91%) for payout algorithm alpha. In this example, payout algorithm beta may be based on two subscription based progressives being selected. In another example shown in FIG. 6C, three subscription based progressives were selected (e.g., PROGRESSIVE JACKPOT 2, PROGRESSIVE JACKPOT 4, and PROGRESSIVE JACKPOT N). In this example, a new payout algorithm lambda may be utilized to reduce the payout rate (e.g., 89.8%) versus the payout rates (e.g., 91% and 90%) for payout algorithm alpha and payout algorithm beta, respectively.

Figure 7A:
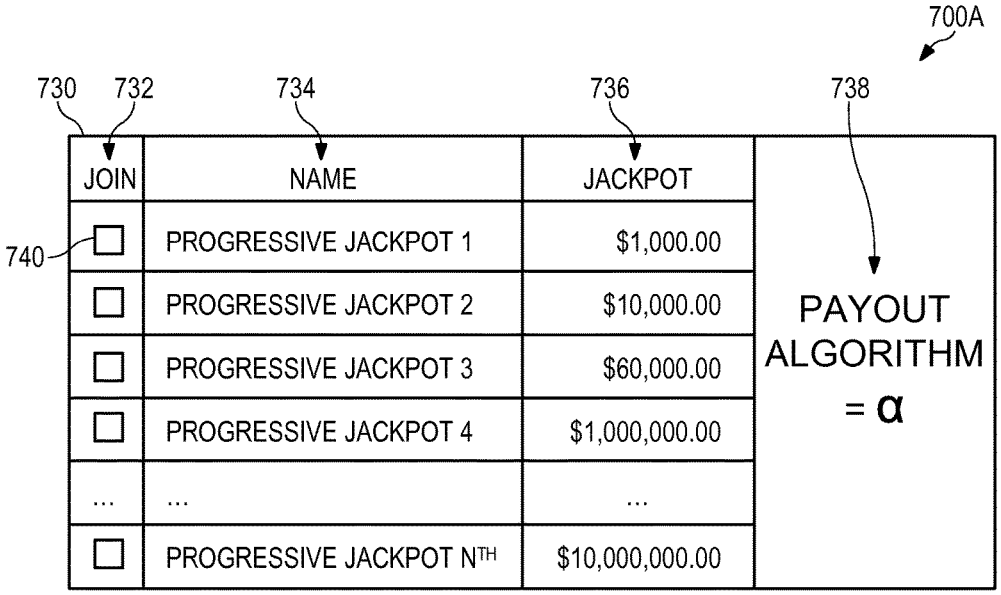
FIG. 7A is another illustration of subscription based progressive game play on a gaming device, according to one embodiment.
Figure 7B:
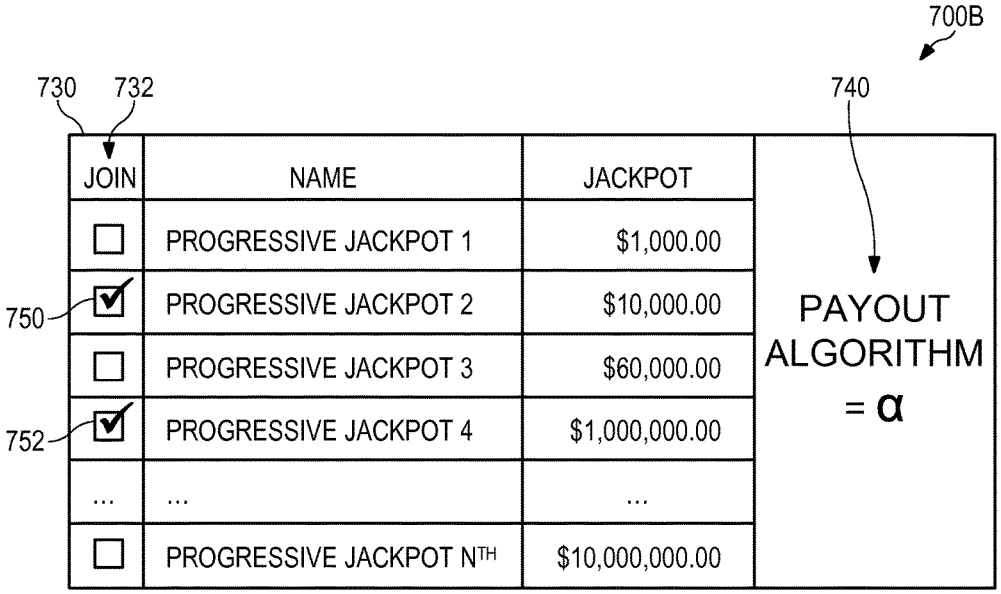
FIG. 7B is another illustration of subscription based progressive game play on a gaming device, according to one embodiment.

In FIG. 7A, another illustration of subscription based progressive game play on a gaming device 700A is shown, according to one embodiment. In this example, the player has selected two subscription based progressive options (see FIG. 7B). However, the payout algorithm alpha has not been modified. The payout algorithm may not be modified based on player card information (e.g., high roller, long-time customer, subscription based player card, etc.), a special promotion, a special event, the time of day, and/or any other factor.

Figure 8:
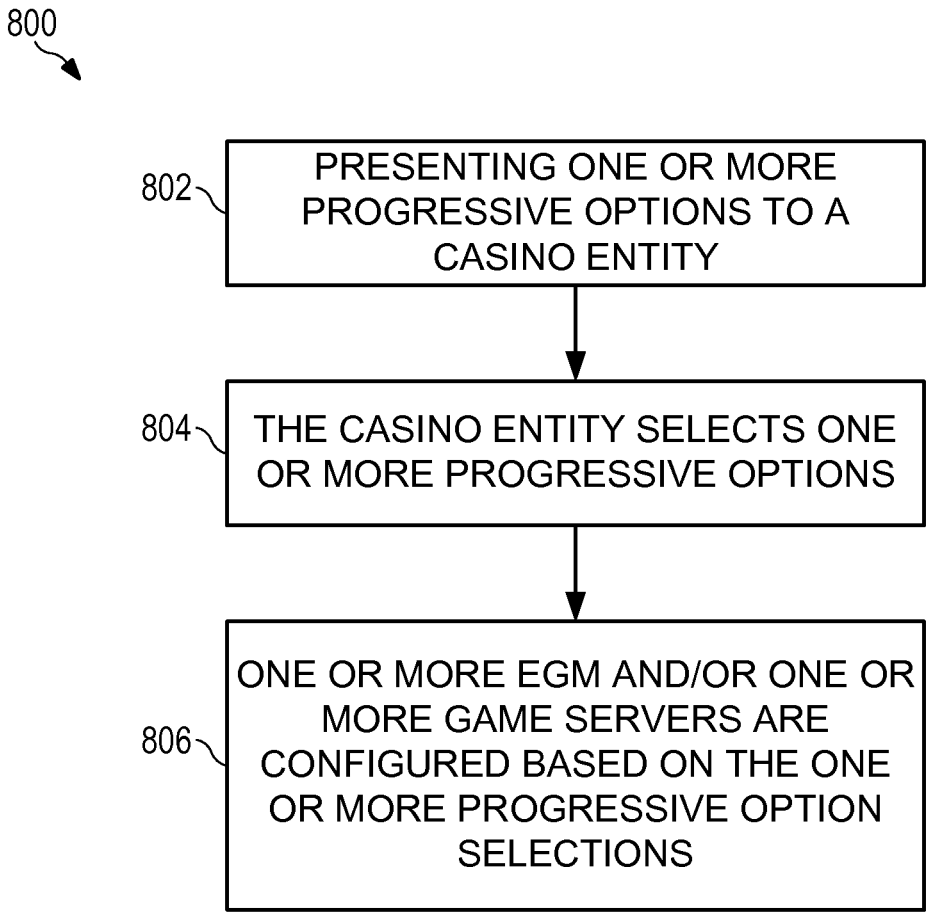
FIG. 8 is a flowchart for subscription based progressive game play on a gaming device, according to one embodiment.

In FIG. 8, a flowchart for subscription based progressive game play on a gaming device 800 is shown, according to one embodiment. The method may include presenting one or more progressive options to a casino entity (step 802). The method may also include the casino entity selecting one or more progressive options (step 804). The method may include one or more electronic gaming machines and/or one or more game servers being configured based on the one or more progressive option selections (step 806).

Figure 9:
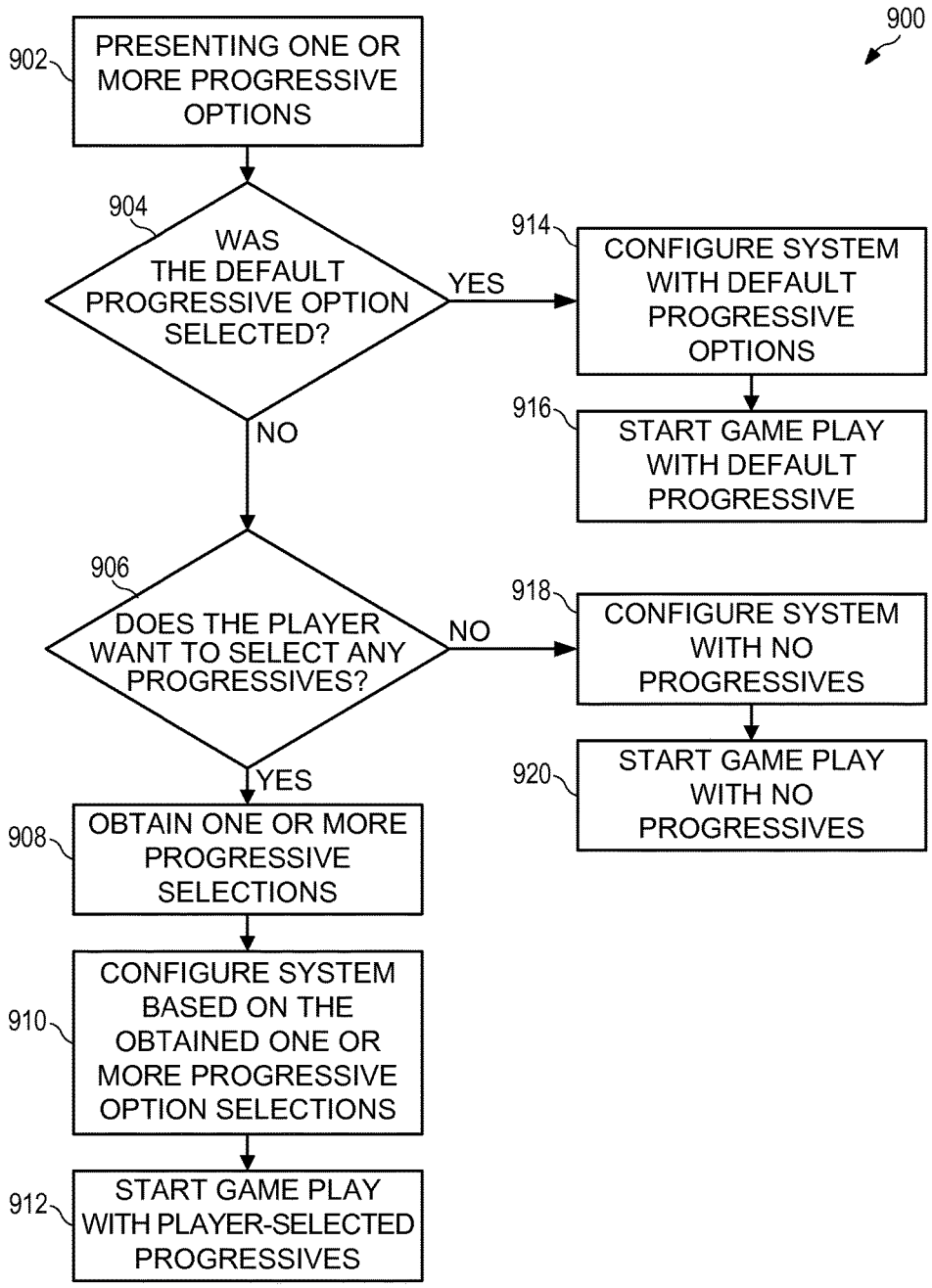
FIG. 9 is another flowchart for subscription based progressive game play on a gaming device, according to one embodiment.

In FIG. 9, another flowchart for subscription based progressive game play on a gaming device 900 is shown, according to one embodiment. The method may include presenting one or more progressive options (step 902). The method may include one or more processors (via electronic gaming device 100 and/or electronic gaming system 200) determining whether the default progressive option was selected (step 904). If the default progressive option was selected, then the method may include configuring the system with the default progressive options (step 914). The method may then include starting game play with the default progressive functionality (step 916). If the default progressive option was not selected, then the method may include one or more processors (via electronic gaming device 100 and/or electronic gaming system 200) determining whether the player wants to select any progressive options (step 906). If the player does not want to select any progressive options, then the method may include configuring the system with no progressive options (step 918). Further, the method may include starting game play with no progressive options (step 920). If the player does want to select one or more progressive options, then the method may include obtaining one or more progressive selections (step 908). The method may further include configuring the system based on the obtained one or more progressive option selections (step 910). The method may include starting game play with player-selected progressive functionalities (step 912). For example, a player may be prompted before game play as to whether the player would like to utilize a default subscription progressive option. In this example, the default subscription progressive option may be PROGRESSIVE JACKPOT 1 which cost 5 credits and/or modifies the payout algorithm. If the player declines this default option, the gaming device may ask the player whether the player would like to select one or more subscription based progressive options. If the player declines this selection request, then the gaming system implements game play without any subscription based progressive options.

Figure 10:
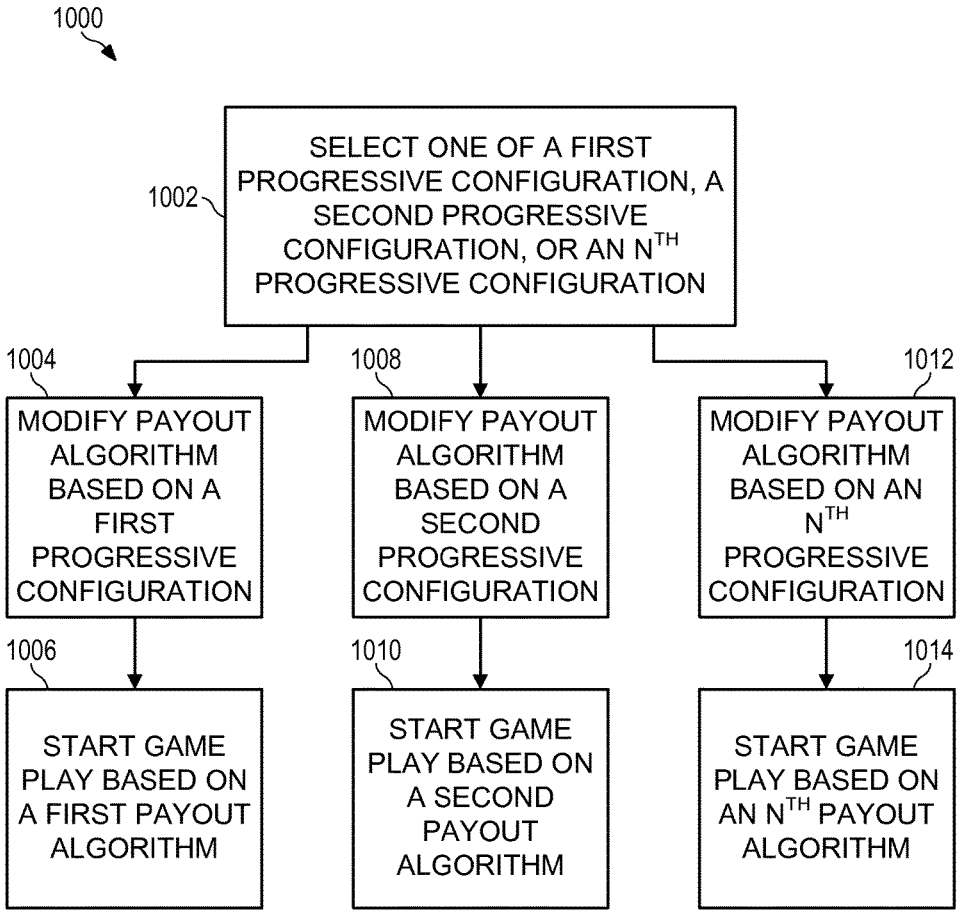
FIG. 10 is another flowchart for subscription based progressive game play on a gaming device, according to one embodiment.

In FIG. 10, another flowchart for subscription based progressive game play on a gaming device 1000 is shown, according to one embodiment. In this example, a method may include a player, a casino, a gaming entity, and/or any other party selecting one of a first progressive configuration, a second progressive configuration, and/or an Nth progressive configuration (step 1002). If the first progressive configuration is selected, then the method may modify the payout algorithm based on a first progressive configuration (step 1004). The method may then include starting game play based on the first payout algorithm (step 1006). If the second progressive configuration is selected, then the method may modify the payout algorithm based on a second progressive configuration (step 1008). The method may then include starting game play based on the second payout algorithm (step 1010). If the Nth progressive configuration is selected, then the method may modify the payout algorithm based on the Nth progressive configuration (step 1012). The method may then include starting game play based on the Nth payout algorithm (step 1014). For example, if a player selects a first subscription based progressive option (e.g., PROGRESSIVE JACKPOT 1 AND PROGRESSIVE JACKPOT 2), then the payout algorithm may be modified from 95% payout to 94%. In another example, if a player selects a second subscription based progressive option (e.g., PROGRESSIVE JACKPOT 1, PROGRESSIVE JACKPOT 2, and PROGRESSIVE JACKPOT 3), then the payout algorithm may be modified from 95% payout to 93%. In another example, if a player selects a third subscription based progressive option (e.g., PROGRESSIVE JACKPOT 1, PROGRESSIVE JACKPOT 2, PROGRESSIVE JACKPOT 3, and PROGRESSIVE JACKPOT 4), then the payout algorithm may be modified from 95% payout to 90%.

Figure 11:
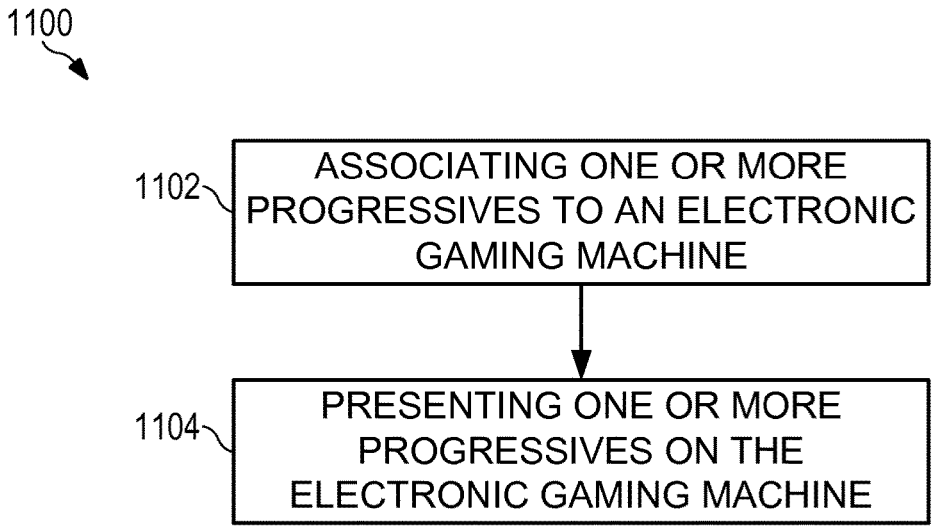
FIG. 11 is another flowchart for subscription based progressive game play on a gaming device, according to one embodiment.

In FIG. 11, another flowchart for subscription based progressive game play on a gaming device 1100 is shown, according to one embodiment. The method may include associating one or more progressives to an electronic gaming machine (step 1102). The method may include presenting one or more progressives on the electronic gaming machine (step 1104).

Figure 12A:
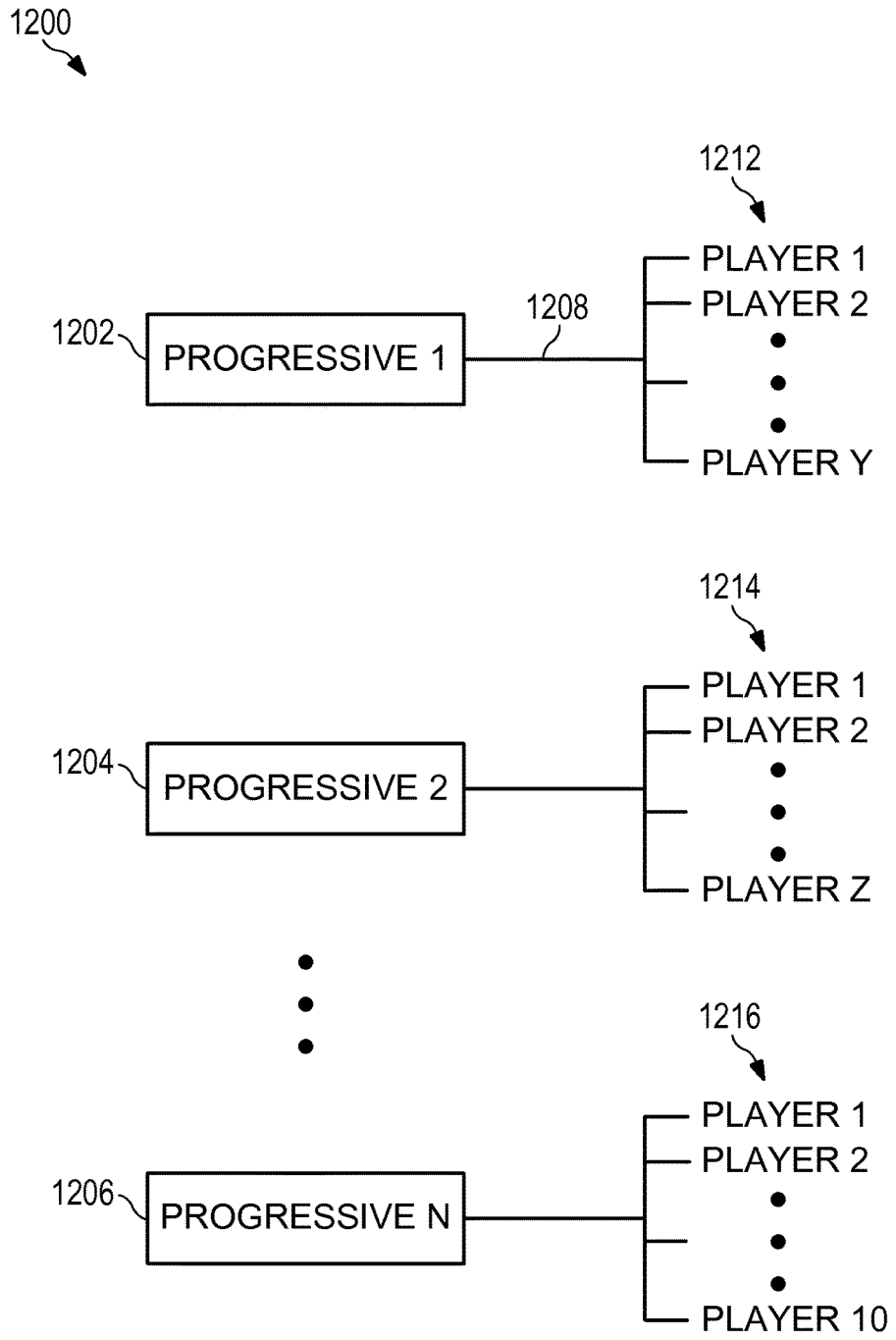
FIG. 12A is another illustration of subscription based progressive game play on a gaming device, according to one embodiment.

In FIG. 12A, another illustration of subscription based progressive game play on a gaming device 1200 is shown, according to one embodiment. In various examples, one or more subscription based progressive may be related to one or more players. In one example, a first subscription progressive 1202 may have a pool of participating players which includes player 1, player 2, and player Y. Whereas, a second subscription progressive 1204 may have a pool of participating players (e.g., the player eligible to win second subscription progressive) of player 1, player 2, and player Z. Further, an Nth subscription progressive 1206 may have a pool of participating players which includes player 1, player 2, and player 10. In these examples, the pool of participating players may include identical players, a constant number of players, independent players (e.g., no overlapping players), a varying number of players, a random number of players, players paying for a subscription, players not paying for a subscription (e.g., loyalty program), and/or any combination thereof.

Figure 12B:
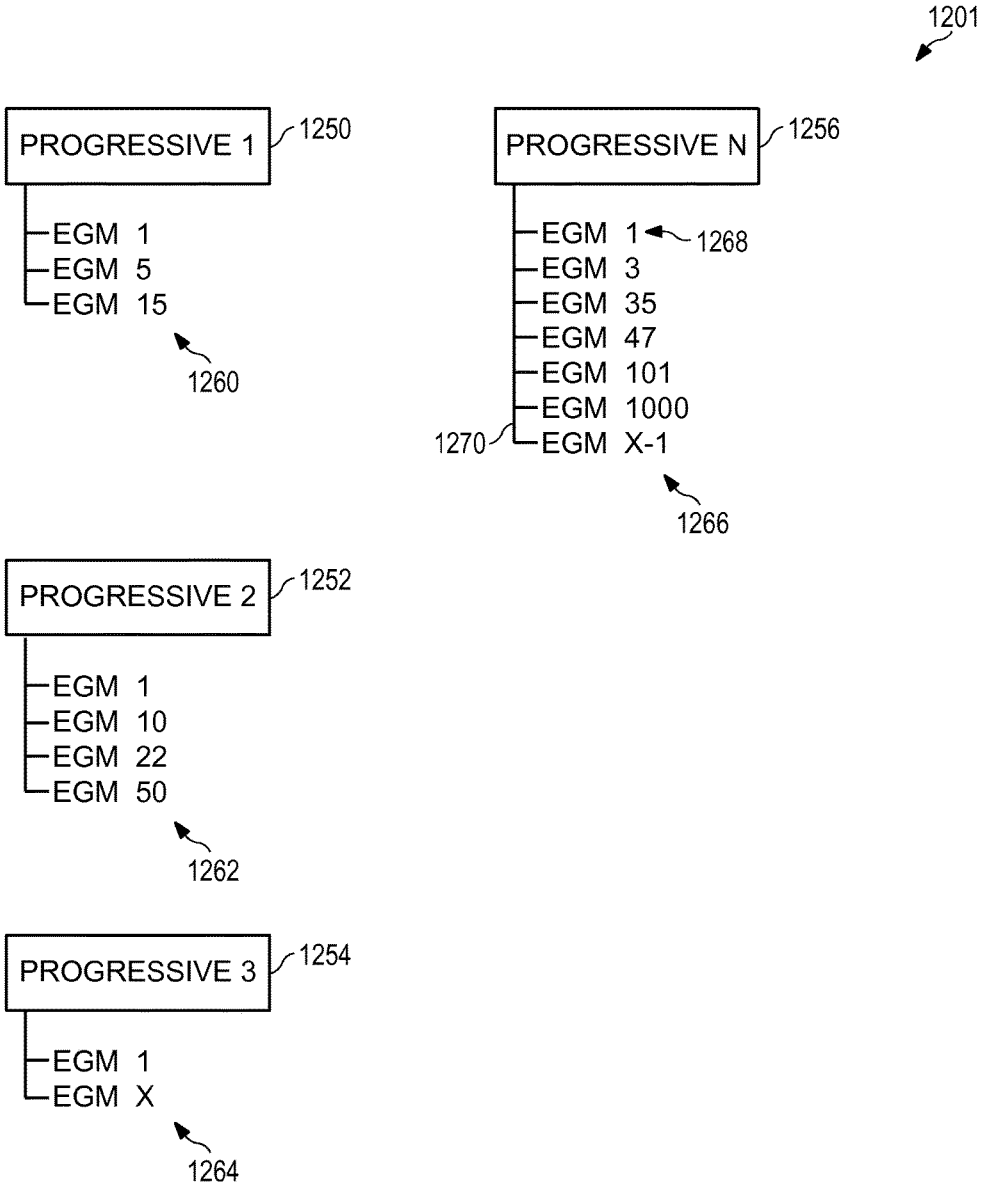
FIG. 12B is another illustration of subscription based progressive game play on a gaming device, according to one embodiment.

In FIG. 12B, another illustration of subscription based progressive game play on a gaming device 1201, according to one embodiment. In various examples, one or more subscription based progressive may be related to one or more electronic gaming devices. In one example, a first subscription based progressive 1250 may be utilized on EGM 1, EGM 5, and EGM 15. Whereas, a second subscription based progressive 1252 may be utilized on EGM 1, EGM 10, EGM22, and EGM 50. In addition, a third subscription based progressive 1254 may be utilized on EGM 1 and EGM X. Whereas, an Nth subscription based progressive 1256 may be utilized on EGM 1, EGM 3, EGM 35, EMG 47, EGM 101, EGM 1000, and EGM X-1.

Figure 13:
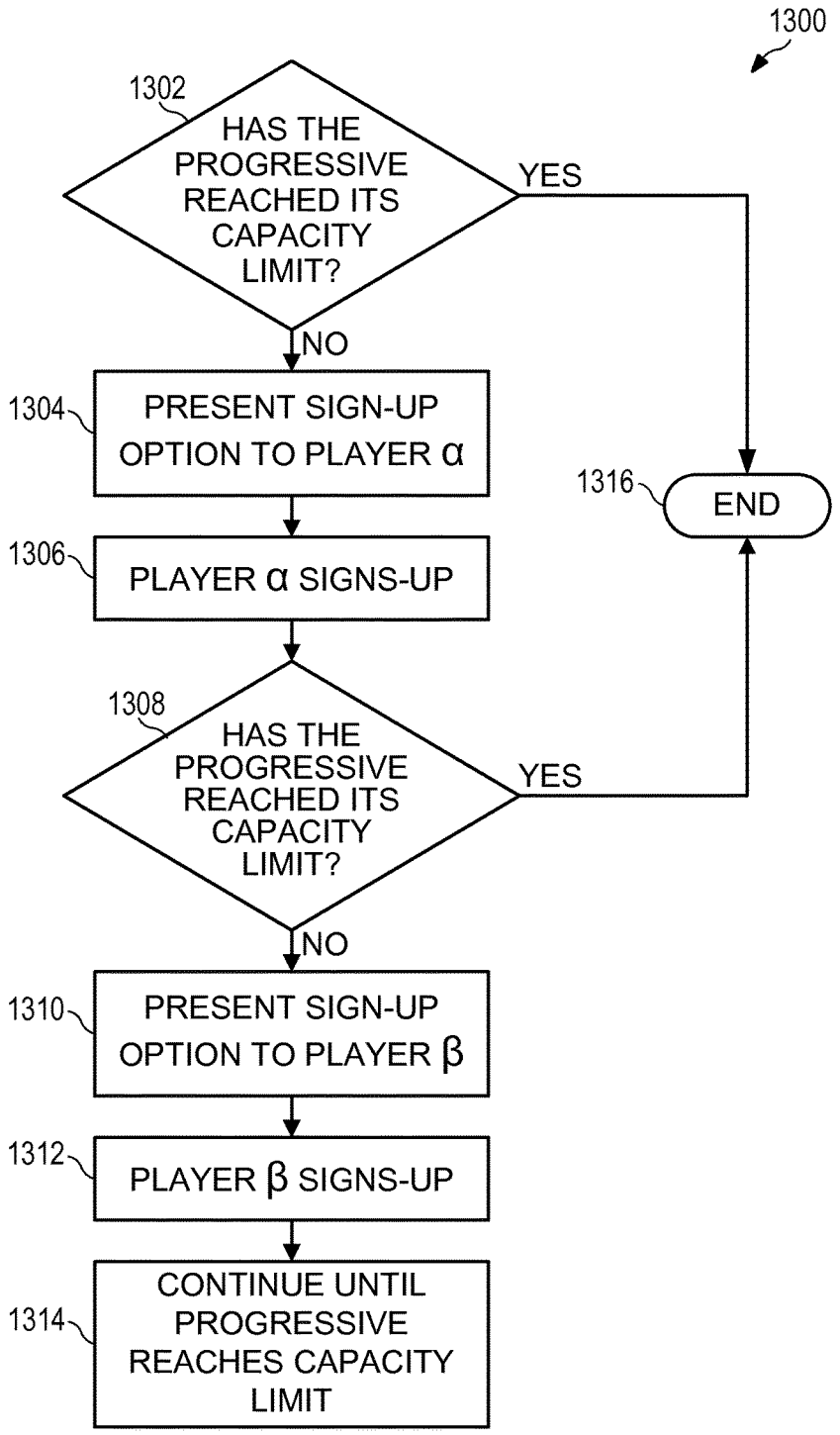
FIG. 13 is a game play flow diagram, according to one embodiment.

In FIG. 13, a game play flow diagram 1300 is shown, according to one embodiment. The method may include one or more processors (via electronic gaming device 100 and/or electronic gaming system 200) may determine whether the progressive has reached its capacity limit (step 1302). If the progressive has reached its capacity limit, then the method may end (step 1316). If the progressive has not reached its capacity limit, then the method may include presenting a sign-up option to player alpha (step 1304). The method may include player alpha signing up for the progressive (step 1306). The method may include one or more processors (via electronic gaming device 100 and/or electronic gaming system 200) may determine whether the progressive has reached its capacity limit (step 1308). If the progressive has reached its capacity limit, then the method may end (step 1316). If the progressive has not reached its capacity limit, then the method may include presenting a sign-up option to player beta (step 1310). The method may include player beta signing up for the progressive (step 1312). The method may include continuing this sign-up process until the progressive has reached its capacity limit (step 1314). For example, a first subscription based progressive is limited to 100 players (and/or any other number may be utilized) which can subscribe to be eligible to win the first subscription based progressive jackpot. In this example, 95 players have signed up to participate in the first subscription based progressive. Therefore, when player Bob starts game play on the electronic gaming device, the electronic gaming device may offer player Bob the opportunity to join the first subscription based progressive because 5 players may join first subscription based progressive before the capacity limit for first subscription based progressive is reach. If player Bob joins the first subscription based progressive, then 4 more players may join before the capacity limit for first subscription based progressive is reach.

Figure 14:
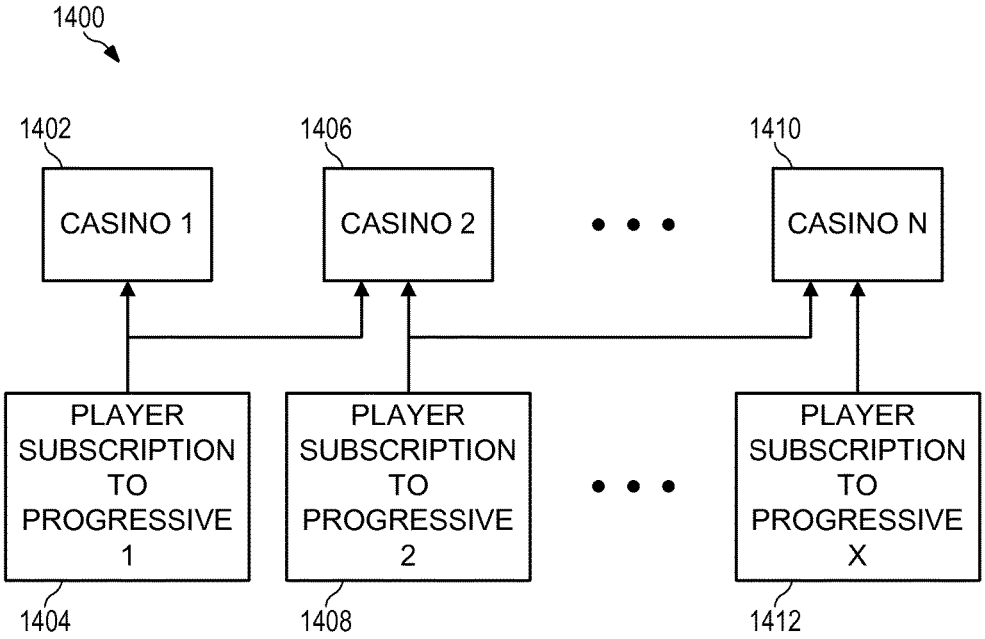
FIG. 14 is a flow diagram for game play, according to one embodiment.

In FIG. 14, a flow diagram for game play 1400 is shown, according to one embodiment. In one example, a first casino 1402 may have a first progressive functionality 1404 associated with first casino 1402. In another example, a second casino 1406 may have first progressive functionality 1404 and a second progressive functionality 1408 associated with second casino 1406. In another example, an Nth casino 1410 may have second progressive functionality 1408 and an Nth progressive functionality 1412 associated with Nth casino 1410.

Figure 15:
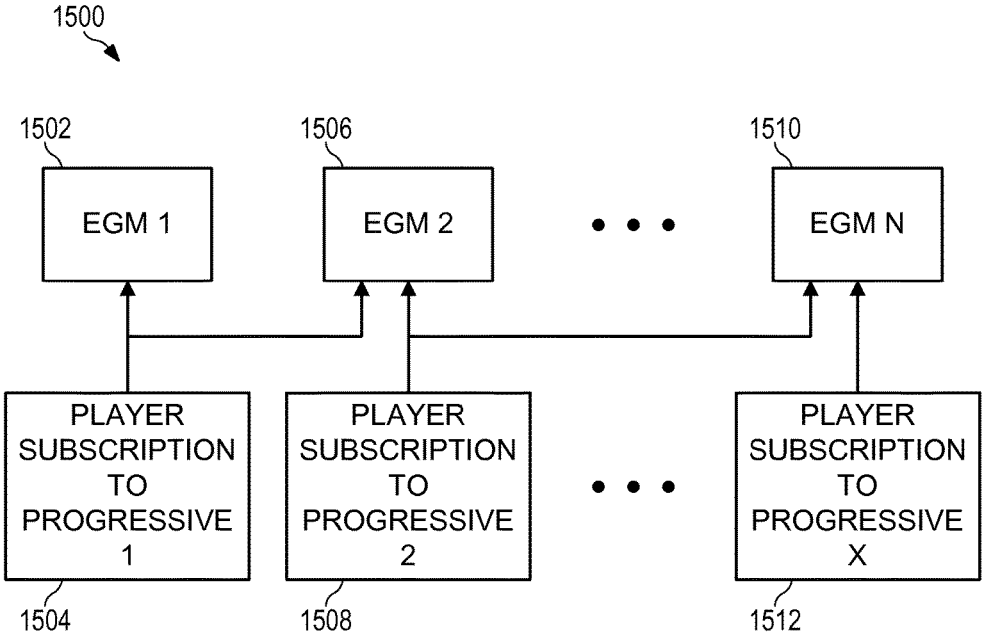
FIG. 15 is a flow diagram for game play, according to one embodiment.

In FIG. 15, a flow diagram for game play 1500 is shown, according to one embodiment. In one example, a first electronic gaming device 1502 may have a first progressive functionality 1504 associated with first electronic gaming device 1502. In another example, a second electronic gaming device 1506 may have first progressive functionality 1504 and a second progressive functionality 1508 associated with second electronic gaming device 1506. In another example, an Nth electronic gaming device 1510 may have second progressive functionality 1508 and an Nth progressive functionality 1512 associated with Nth electronic gaming device 1510.

Figure 16:
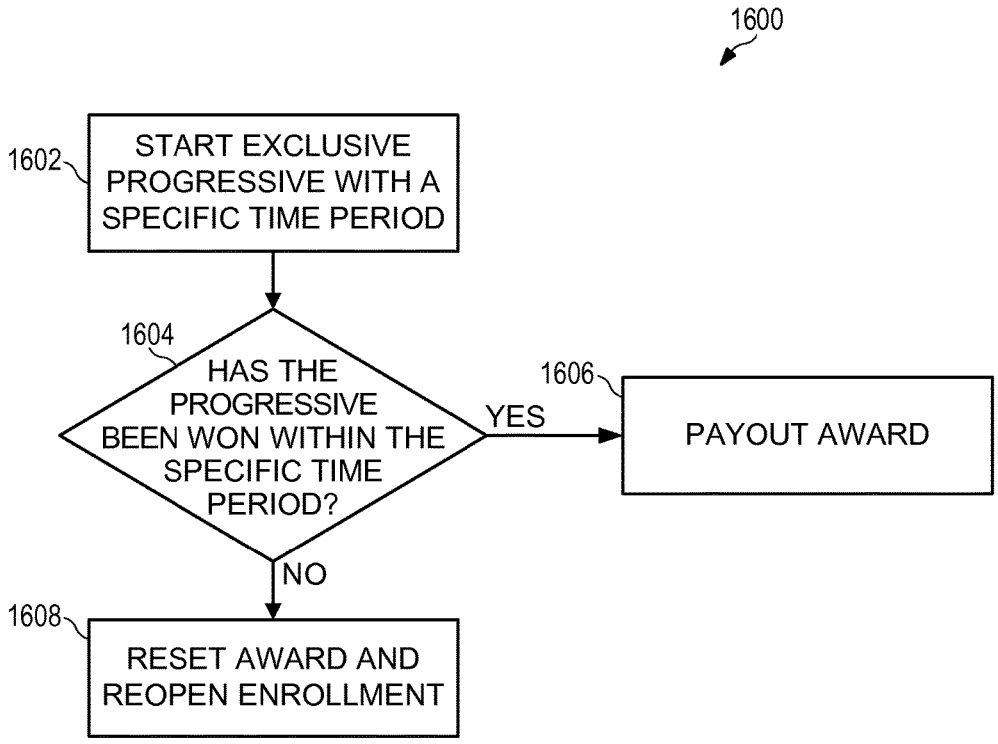
FIG. 16 is a flow diagram for game play, according to one embodiment.

In FIG. 16, a flow diagram for game play 1600 is shown, according to one embodiment. The method may include starting exclusive progressive with a specific time period (step 1602). The method may include one or more processors (via electronic gaming device 100 and/or electronic gaming system 200) determining whether the progressive has been won within a specific time period (step 1604). If the progressive has been awarded within the specific time period, then the method may payout the award (step 1606). If the progressive has not been award within the specific time period, then the method may reset the payout award and reopen the enrollment procedure (step 1608). For example, an exclusive progressive that allows a predetermined number (e.g., 1-N) of players to be eligible for a progressive may be limited to a predetermined time frame. In this example, Player Steve, Player Bob, and Player Lisa may be eligible for this award. In this example, a $1000 award may be won by the predetermined number of players (e.g., Player Steve, Player Bob, and Player Lisa) if the prize is won within a predetermined time frame (e.g., 2 days). If none of the predetermined number of players (e.g., Player Steve, Player Bob, and Player Lisa) wins the prize with the time frame (e.g., 2 days), then the award is reset and enrollment for this award is reset and reopened. Therefore, new players (e.g., Player Mike, Player Kim, Player Zenta, and Player Werner) may register for the new award (e.g., $1500, etc.).

Figure 17:
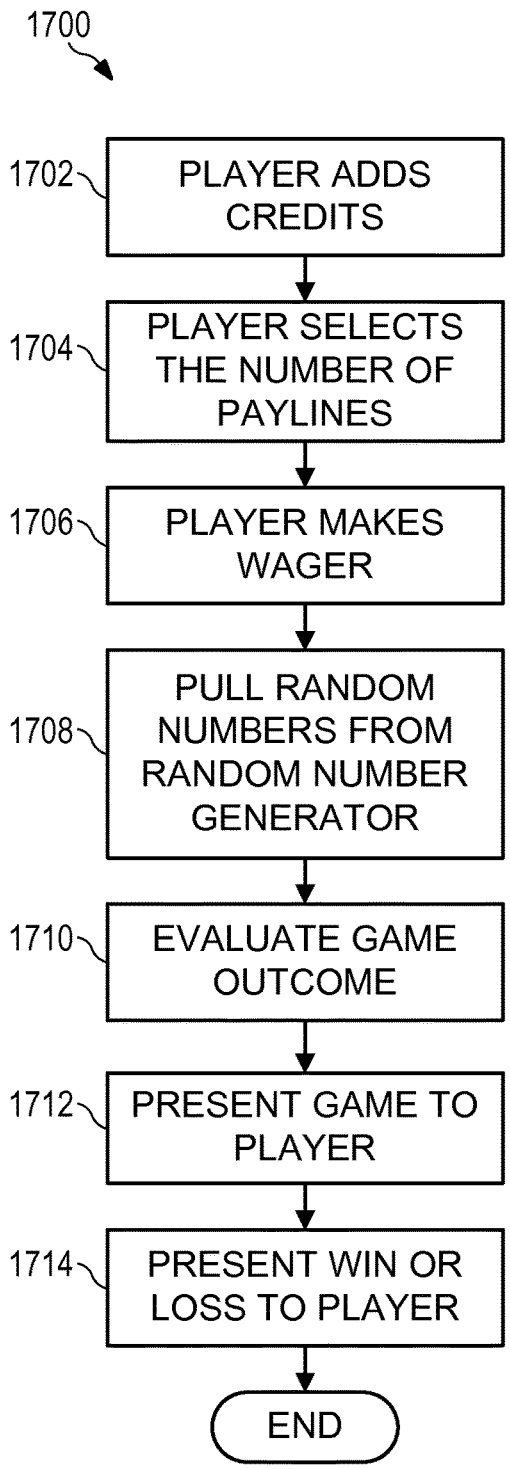
FIG. 17 is a flow diagram for game play, according to one embodiment.

FIG. 17 is a process flowchart of one example of a primary game play 1700 on an electronic gaming system, according to one embodiment. The method may include the step of a player adding credit to the electronic gaming system (step 1702). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1704, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1706, the player makes a wager on the game. In one embodiment, the wager may be a multiple of the number of paylines selected at step 1704. In another embodiment, the wager may not be a multiple of the number of paylines selected at step 1704. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1704 and 1706 may be not critical, and so for example, a player can select the wager they wish to place, and then select the number of paylines they want it applied to, and that these embodiments are expressly contemplated as being within the scope of the present disclosure.

Continuing to step 1708, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1710 and 1712, the gaming system utilizes the random numbers pulled at step 1708 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1714, the win or loss outcome may be identified for the player. In one embodiment, this step can include additional messaging, which provides information related to the win or loss, such as why the player won or lost. In another embodiment, this step can include identification of the amount of any award earned by the player.

Figure 18:
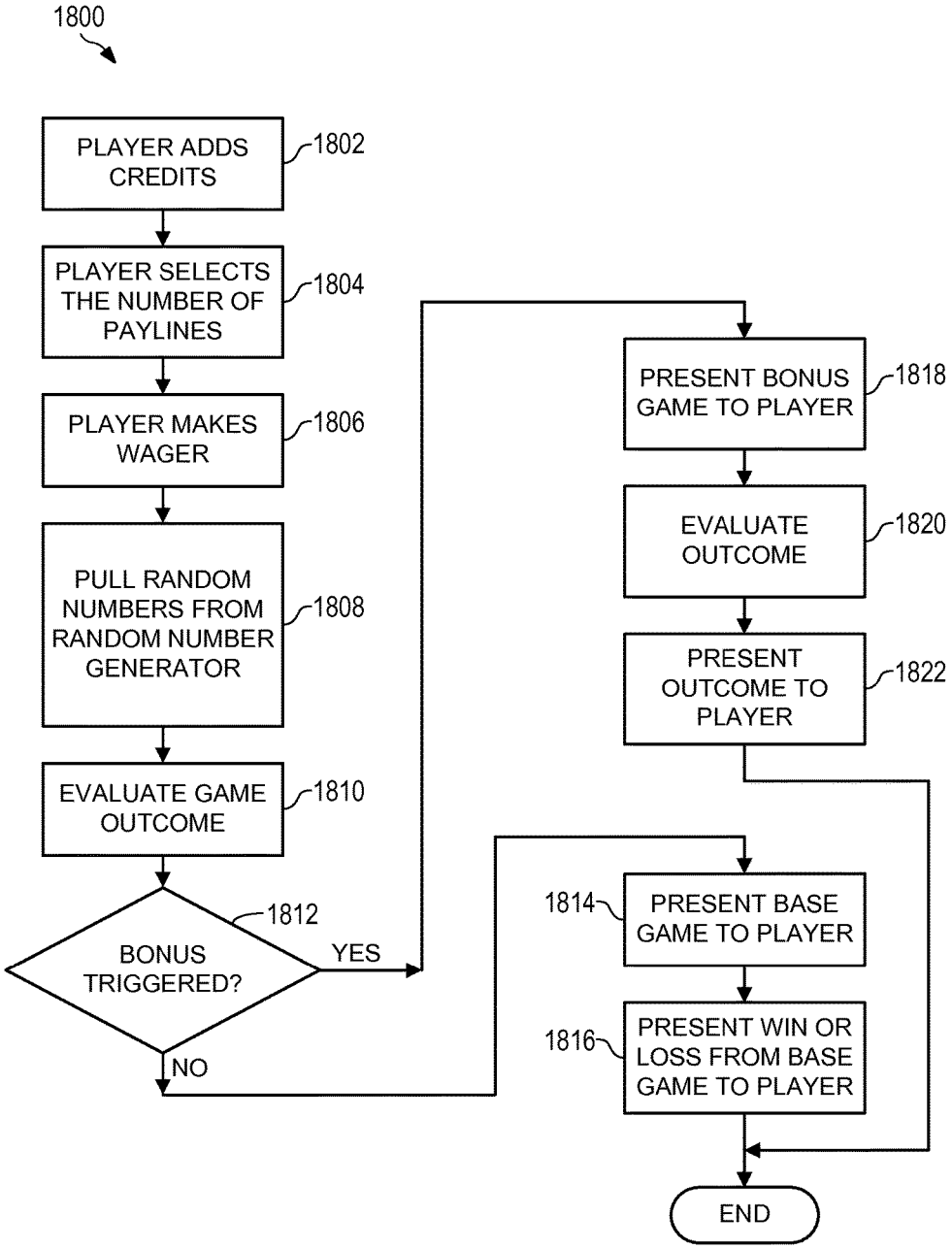
FIG. 18 is a flow diagram for game play, according to one embodiment.

FIG. 18 is a process flowchart of one example of a combined primary and secondary game play 1800 on an electronic gaming system, according to one embodiment. The method may include the step of a player adding credit to the electronic gaming system (step 1802). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1804, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1806, the player makes a wager on the game. In one embodiment, the wager may be a multiple of the number of paylines selected at step 1804. In another embodiment, the wager may not be a multiple of the number of paylines selected at step 1804. In a further embodiment, the wager may include a side-wager, which may, in one example of such an embodiment, be used to make the player eligible to be awarded the extra functionality discussed above. It should be appreciated that in some embodiments, the order of steps 1804 and 1806 may be not critical, and so for example, a player can select the wager they wish to place, and then select the number of paylines they want it applied to, and that these embodiments may be expressly contemplated as being within the scope of the present disclosure.

Continuing to step 1808, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 1810, the gaming system utilizes the random numbers pulled at step 1808 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1812, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 1814, where the base game may be fully presented to the player. As discussed above, the orders of step 1810, 1812, and 1814 can be changed without affecting the novel concepts disclosed herein.

At step 1816, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 1812 that a bonus or secondary game was triggered, then process 1800 continues to step 1818, where the secondary game may be presented to the player. As discussed above, there are numerous ways to present the secondary or bonus game to the player.

At steps 1820 and 1822, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 1800 ending after step 1822, the process continues to step 1814 so as to finalize the primary game outcome presentation to the player.

Figure 19:
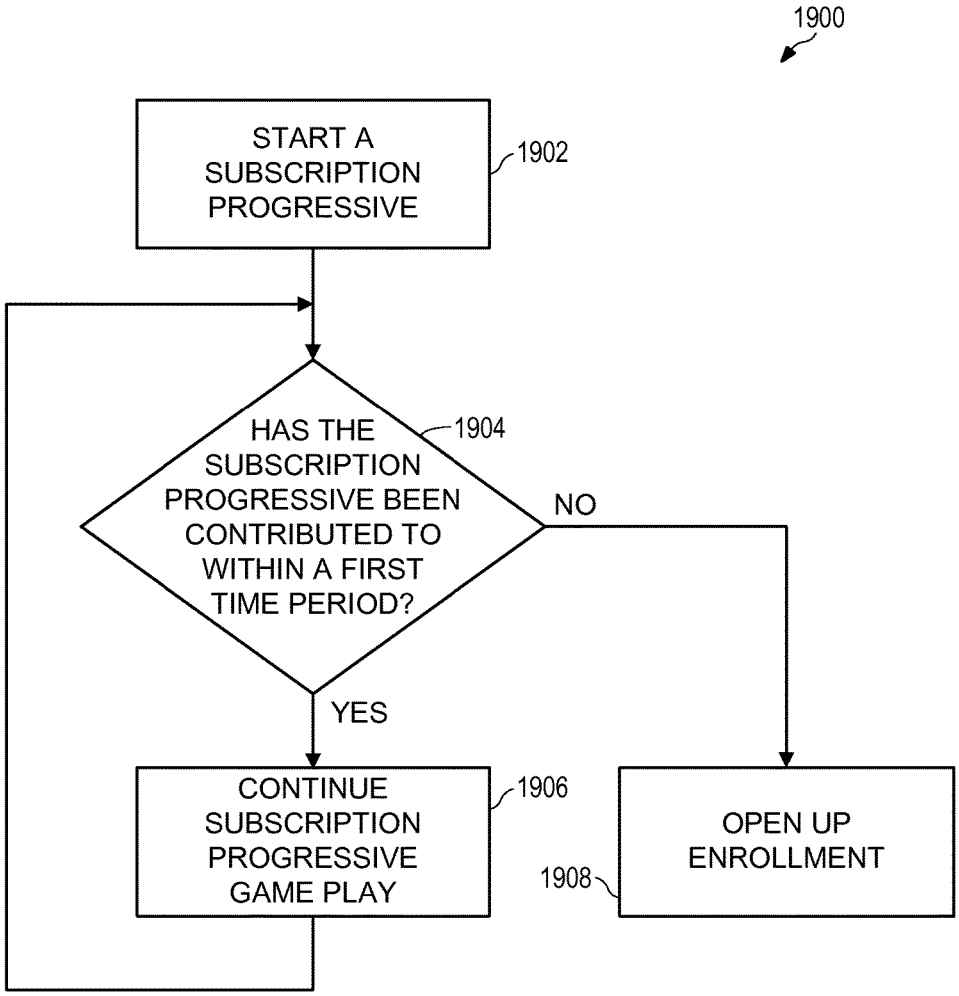
FIG. 19 is a flow diagram for game play, according to one embodiment.

In FIG. 19, a flow diagram for game play 1900 is shown, according to one embodiment. The method may include starting a subscription progressive (step 1902). The method may include one or more processors (via electronic gaming device 100 and/or electronic gaming system 200) determining whether the subscription progressive has been contributed to within a first time period (step 1904). If the subscription progressive has not been contributed to within a first time period, then the method may open up enrollment to the subscription progressive (step 1908). If the subscription progressive has been contributed to within the first time period, then the method may continue the subscription progressive game play (step 1906) and return to step 1904. For example, a subscription based progressive must be contribute to within a predetermined period (e.g., 5 days, etc.) by one or more of the eligible players and if it is not contributed to within that time frame by one or more of the eligible players, then the eligible players may be removed from enrollment and the enrollment procedure is restarted. In another example, only the players that have not contributed to the progressive are removed, and the enrollment procedure is restarted for any open spaces (e.g., the spaces opened up by the players which were removed).

In one embodiment, the electronic gaming device may include a plurality of reels, one or more memory devices, and one or more processors. The plurality of reels may include one or more areas. The memory may include one or more subscription based progressive structures. The processor may generate one or more symbols to be located in the one or more areas.

In another example, the processor may register a first player for a first subscription based progressive. Further, the processor may charge the first player a first fee for participation in the first subscription based progressive. In addition, the processor may initiate a first modification of a payout algorithm based on participation in the first subscription based progressive. In another example, the processor may register a second player for a second subscription based progressive. Further, the processor may charge the second player a second fee for participation in the second subscription based progressive. In another example, the processor may initiate a second modification of a payout algorithm based on participation in the second subscription based progressive. Further, the processor may store one or more subscription based progressive structures based on a game registration procedure.

In another embodiment, the method of providing game play via an electronic gaming device may include: determining a number of player in a first subscription based progressive; comparing the number of players versus a subscription based progressive capacity; displaying a request for a first player to participate in the first subscription based progressive; and/or enrolling the first player in the first subscription based progressive based on a player input.

In addition, the method may include: determining whether a first progressive payout has been awarded within a predetermined time period and resetting the first progressive payout and reopening enrollment in the first subscription based progressive based on the first progressive payout not being award within the predetermined time period; determining whether the first subscription based progressive has been contributed to within a predetermined time period; continuing the first subscription based progressive based on a contribution being implemented within the predetermined time period; and/or reopening enrollment in the first subscription based progressive based on a lack of a contribution being implemented within the predetermined time period.

In another embodiment, the electronic gaming system may include a server including a server processor and a server memory and a display device including a plurality of reels. The plurality of reels may include one or more areas. The server memory may include one or more subscription based progressive structures. The server processor may generate one or more symbols to be located in the one or more areas.

In addition, the server processor may register a first player for a first subscription based progressive. Further, the server processor may charge the first player a first fee for participation in the first subscription based progressive. In another example, the server processor may initiate a first modification of a payout algorithm based on participation in the first subscription based progressive. Further, the server processor may register a second player for a second subscription based progressive. In addition, the server processor may charge the second player a second fee for participation in the second subscription based progressive. In another example, the server processor may initiate a second modification of a payout algorithm based on participation in the second subscription based progressive.

In various examples, subscriptions based progressives may be where a patron can select which progressives he/she wants to contribute to as well as eligible to win. Further, the subscription based progressives may be where a casino can subscribe to multiple wide area progressives ("WAP") configurations from different servers. In a casino, a non-subscription based progressive is configured for an EPS and a patron is forced to contribute to the non-subscription based progressive by playing the game. In various examples, a patron may choose not to contribute to the non-subscription based progressive and/or the patron wants to contribute to a different progressive pool. In another example, a server can handle different WAP progressives from different WAP servers. In another example, a patron may choose not to contribute to a progressive that is configured for the game. In this example, the payback of the game may be dynamically adjusted to account for this decision. Further, N number of progressives may be associated with a gaming device. In addition, a patron may choose (or subscribe to) N number of progressives at any time. In another example, N number of patrons may subscribe to N number of progressives exclusively and no other patron may be allowed to participate in those progressives. Further, the subscribed progressive may be made available to all patrons across different casinos using server based WAP subscription. In addition, one or more progressives that a patron subscribes to may follow the patron from one game to another game as well as from casino to casino. In another example, when N number of patrons subscribe to a progressive exclusively, the progressive may be required to be won by a specified period (e.g., for mystery WAP, mystery LAP, etc.). In another example, when N number of patrons subscribes to a progressive exclusively, and the progressive has not been contributed to within a specified period of time, the progressive may become void and other patrons can subscribe to the progressive, without the amount being reset. In another example, a bonus game may be associated with winning one or more progressives. In another example, a patron can pay extra (e.g., monthly fee, fee per spin, etc.) to buy into one or more progressives. In another example, the contributions to the subscribed progressives may be configured to come out of the payback of the game. In another example, a patron may subscribe to one or more of a LAP, a WAP, a mystery LAP, and/or a mystery WAP. Further, the payback percentages of the game may be dynamically adjusted to account for when a patron is subscribed to and contributing to a progressive.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

at least one display configured to present gaming information to a player of the electronic gaming device;

at least one credit device configured to accept a physical item representing a monetary value, the monetary value funding a player account accessible at the electronic gaming device or a wager at the electronic gaming device;

at least one input device;

a memory, the memory including a plurality of subscription based progressive structures; and a processor configured to execute machine readable instructions stored on the memory, which when executed, cause the electronic gaming machine to perform the following steps in order:

(1) display on the at least one display a plurality of progressive pools available to the player, the progressive pools each being subscription based and comprising a predetermined cost to join the progressive pool and a payout associated with the progressive pool and a cost to remain eligible which is different than the cost to join, wherein the cost to remain eligible varies based on at least one of a number of participants in the progressive pool, a prize size of the payout associated with the progressive pool, and a number of the selected pools subscribed to by the player;

(2) receive an input from the player via the at least one input device to select at least two of the plurality of progressive pools;

(3) determine a total cost required to play the progressive pools selected by the player based on the predetermined cost to join and/or remain eligible for each selected progressive pool;

(4) receive payment from the player via the input device for the total cost and to place a wager for at least one wagering game at the electronic gaming device;

(5) determine an outcome of the at least one wagering game, and determine whether a progressive pool winning event corresponding to one or more of the at least two selected progressive pools was received; and (6) award a progressive jackpot for each progressive pool wining event corresponding to one or more of the at least two selected progressive pools.

2. The electronic gaming device of claim 1, wherein one or more of the plurality of progressive pools may be accessed by multiple gaming machines which present different types of wagering games.

3. The electronic gaming device of claim 1, wherein the predetermined cost to join each progressive is variable.

4. The electronic gaming device of claim 3, where the predetermined cost to join each progressive depends on a number of the selected progressive pools.

5. The electronic gaming device of claim 3, wherein the predetermined cost to join each progressive depends on the payout associated the progressive pool.

6. The electronic gaming device of claim 5, wherein the payout associated with the progressive pool is variable.

7. The electronic gaming device of claim 3, wherein the predetermined cost to join each progressive depends on a length of time the player subscribes to the selected progressive pools.

8. The electronic gaming device of claim 1, wherein the plurality of progressive pools are subscription based progressive pools.

9. The electronic gaming device of claim 8, wherein the cost to join the plurality of progressive pools are based on a length of time subscribed to the progressive pools.

10. The electronic gaming device of claim 1, wherein the predetermined cost to join the progressive pool is a side wager presented at the electronic gaming device.

11. The electronic gaming device of claim 1, wherein the predetermined cost to join the progressive pool comprises part of the wager for the at least one wagering game at the electronic gaming device.

12. The electronic gaming device of claim 1, wherein a base game payout algorithm is modified based on a number of selected progressive pools by the player.

13. The electronic gaming device of claim 12, wherein the base game payout algorithm is modified based on at least one of a player card information, a promotion, and a time of day.

14. The electronic gaming device of claim 1, wherein the at least one wagering game comprises two or more wagering games.

15. The electronic gaming device of claim 1, wherein the cost to join the progressive pool is a subscription.

16. The electronic gaming device of claim 1, wherein the payment for the total cost is received before the payment for the wager.

17. The electronic gaming device of claim 1, wherein each of the progressive pools may be selected and won relative to a plurality of different wagering games.

* * * * *